US011920301B2

(12) United States Patent
Collins

(10) Patent No.: US 11,920,301 B2
(45) Date of Patent: Mar. 5, 2024

(54) WOVEN PAPERMAKING FABRIC HAVING INTERSECTING TWILL PATTERNS

(71) Applicant: Kimberly-Clark Worldwide, Inc., Neenah, WI (US)

(72) Inventor: Lynda Ellen Collins, Neenah, WI (US)

( * ) Notice: Subject to any disclaimer, the term of this patent is extended or adjusted under 35 U.S.C. 154(b) by 113 days.

(21) Appl. No.: 17/279,409

(22) PCT Filed: Sep. 28, 2018

(86) PCT No.: PCT/US2018/053272
§ 371 (c)(1),
(2) Date: Mar. 24, 2021

(87) PCT Pub. No.: WO2020/068092
PCT Pub. Date: Apr. 2, 2020

(65) Prior Publication Data
US 2022/0010490 A1 Jan. 13, 2022

(51) Int. Cl.
*D03D 13/00* (2006.01)
*D21F 7/08* (2006.01)

(52) U.S. Cl.
CPC ..... *D21F 7/08* (2013.01); *D03D 13/00* (2013.01); *D03D 13/004* (2013.01)

(58) Field of Classification Search
CPC ... D21F 7/08; D21F 5/18; D21F 11/00; D21F 1/00; D03D 13/00; D03D 13/004
See application file for complete search history.

(56) References Cited

U.S. PATENT DOCUMENTS 4,191,609 A * 3/1980 Trokhan ..... D21H 25/005 162/207
5,228,482 A * 7/1993 Fleischer ..... D21F 1/0027 139/383 A (Continued)

FOREIGN PATENT DOCUMENTS

CN 2885922 Y 4/2007
CN 204000435 U 12/2014

(Continued)

OTHER PUBLICATIONS

Co-pending U.S. Appl. No. 16/650,058, filed Mar. 24, 2020, by Collins et al. for "Woven Papermaking Fabric Including Stablilized Weave Providing Textured Contacting Surface."

(Continued)

*Primary Examiner* — Robert H Muromoto, Jr.
(74) *Attorney, Agent, or Firm* — KIMBERLY-CLARK WORLDWIDE, INC.

(57) ABSTRACT

Woven papermaking fabrics useful in the manufacture of fibrous structures, particularly wet-laid tissue products that allow the web contacting surface of the fabric to be woven with three-dimensional topography comprising protuberances that are oriented at an angle relative to both the machine direction (MD) axis and cross-machine (CD) axis of the fabric. The protuberances may be discrete or continuous and, in certain preferred embodiments, intersect one another to form discrete valleys there between. The valleys may have relatively steep sidewalls, such as wall angles greater than 22 degrees, and be relatively deep, such as valley depths greater than about 0.35 mm.

26 Claims, 7 Drawing Sheets

(56) References Cited

U.S. PATENT DOCUMENTS 5,240,763 A * 8/1993 Wagner ..... D21F 1/0027 162/902
5,449,026 A * 9/1995 Lee ..... D21F 7/083 139/383 A
5,456,293 A * 10/1995 Ostermayer ..... D21F 1/0027 139/383 A
5,520,225 A * 5/1996 Quigley ..... D21F 1/0027 139/383 A
5,713,397 A * 2/1998 Quigley ..... D21F 11/006 139/383 A
5,817,400 A * 10/1998 Chen ..... A61F 13/533 264/284
5,832,962 A * 11/1998 Kaufman ..... D21F 11/006 162/902
5,906,306 A * 5/1999 Rajala ..... B65H 20/12 156/496
6,402,895 B1 * 6/2002 Best ..... D21F 1/0027 162/902
6,592,714 B2 7/2003 Lamb
6,660,362 B1 * 12/2003 Lin ..... D21F 11/145 162/902
6,673,202 B2 * 1/2004 Burazin ..... D21F 5/18 162/122
6,991,706 B2 * 1/2006 Lindsay ..... D21H 27/30 162/134
7,166,189 B2 * 1/2007 Burazin ..... D21F 11/14 162/902
7,235,156 B2 * 6/2007 Baggot ..... B31F 1/07 162/111
7,294,229 B2 * 11/2007 Hada ..... D21F 11/006 428/156
7,300,543 B2 * 11/2007 Mullally ..... D21F 11/006 428/156
7,323,072 B2 * 1/2008 Engelhart ..... D04H 1/542 156/73.2
7,611,605 B2 11/2009 Burazin et al.
7,611,607 B2 11/2009 Mullally et al.
7,726,349 B2 6/2010 Mullally et al.
7,935,409 B2 * 5/2011 Burazin ..... D21H 27/002 428/174
9,259,075 B2 * 2/2016 Gordon ..... A47K 7/02
10,280,567 B2 * 5/2019 Vogt ..... D21H 27/02
10,349,799 B2 * 7/2019 Bradley ..... B32B 7/08
10,385,511 B2 * 8/2019 Burazin ..... D21H 27/002
10,563,353 B2 * 2/2020 Collins ..... D03D 15/567
10,927,506 B2 * 2/2021 Zanon ..... A47K 10/16
11,313,079 B2 * 4/2022 Collins ..... D21F 11/14
11,377,793 B2 * 7/2022 Collins ..... D21F 5/18
11,377,797 B2 * 7/2022 Collins ..... D21H 27/02
11,421,384 B2 * 8/2022 Rekoske ..... D21F 5/182
2001/0032712 A1 * 10/2001 Friedbauer ..... B31F 1/07 162/361
2002/0056536 A1 * 5/2002 Lamb ..... D21F 11/14 162/903
2003/0079850 A1 * 5/2003 Rougvie ..... D21F 1/0027 442/212
2003/0084952 A1 * 5/2003 Burazin ..... D21F 1/0036 162/902
2007/0209770 A1 * 9/2007 Barrett ..... D21F 11/14 162/358.2
2008/0110591 A1 * 5/2008 Mullally ..... D21F 11/006 162/358.2
2008/0169040 A1 * 7/2008 Barrett ..... D21F 1/0036 162/903
2009/0065166 A1 * 3/2009 Quigley ..... D21F 1/0027 139/420 R
2009/0205797 A1 8/2009 Fernandes et al.
2009/0211722 A1 8/2009 Crook et al.
2014/0231039 A1 * 8/2014 Patel ..... D21F 1/0027 162/289
2016/0215451 A1 * 7/2016 Uymur ..... D21F 1/0036
2017/0211235 A1 * 7/2017 Lamb ..... D21H 27/02
2019/0360152 A1 * 11/2019 Collins ..... D21F 11/006
2020/0240081 A1 * 7/2020 Collins ..... D21F 1/0036
2020/0291575 A1 * 9/2020 Collins ..... D21F 1/0036
2020/0291577 A1 * 9/2020 Collins ..... D21F 11/006
2020/0291578 A1 * 9/2020 Collins ..... D21F 11/006
2020/0340180 A1 * 10/2020 Burazin ..... B65G 15/42
2022/0010490 A1 * 1/2022 Collins ..... D21F 1/00
2022/0010491 A1 * 1/2022 Collins ..... D03D 13/004

FOREIGN PATENT DOCUMENTS

CN 206438338 U 8/2017
WO 0012817 A1 3/2000
WO 13023276 A1 2/2013
WO 20068091 A1 4/2020
WO 20068092 A1 4/2020

OTHER PUBLICATIONS

Co-pending U.S. Appl. No. 16/650,065, filed Mar. 24, 2020, by Collins et al. for "Woven Papermaking Fabric Having Converging, Diverging or Merging Topography."
Co-pending U.S. Appl. No. 16/650,068, filed Mar. 24, 2020, by Collins et al. for "Woven Papermaking Fabric Having Machine and Cross-Machine Oriented Topography."
Co-pending U.S. Appl. No. 16/650,050, filed Mar. 24, 2020, by Collins et al. for "Twill Woven Papermaking Fabrics."
Co-pending U.S. Appl. No. 17/279,423, filed Mar. 24, 2021, by Collins et al. for "Woven Papermaking Fabric Having Discrete Cross-Marchine Direction Protuberances."

* cited by examiner

WOVEN PAPERMAKING FABRIC HAVING INTERSECTING TWILL PATTERNS

In the manufacturing of tissue products, particularly absorbent tissue products such as bath tissue and facial tissue products, there is a continuing need to improve the physical properties of the tissue and offer a differentiated product appearance. It is generally known that molding a partially dewatered cellulosic web on a topographical papermaking fabric will enhance the finished paper product's physical properties, such as sheet bulk, stretch and softness, and aesthetics. Such molding can be applied by fabrics in a through-air dried process, such as the process disclosed in U.S. Pat. No. 5,672,248, or in a wet-pressed tissue manufacturing processes, such as that disclosed in U.S. Pat. No. 4,637,859.

BACKGROUND OF THE INVENTION

Exemplary papermaking fabrics are disclosed in U.S. Pat. No. 6,998,024, which teaches woven papermaking fabrics with substantially continuous machine direction ridges whereby the ridges are made up of multiple warp filaments grouped together. The ridges are higher and wider than individual warps. The wide wale ridges have a ridge width of about 0.3 cm or greater and the frequency of occurrence of the ridges in the cross-machine direction (CD) is from about 0.2 to 3 per centimeter. In the examples shown, the shute diameters are both larger than or smaller than the warp diameters but only one shute diameter is utilized.

Other woven papermaking fabrics are disclosed in U.S. Pat. No. 7,611,607, which teaches fabrics having substantially continuous, not discrete, machine direction ridges separated by valleys, where the ridges are formed of multiple warp filaments grouped together and supported by multiple shute strands of two or more diameters. The ridges are generally oriented parallel to the machine direction axis of the fabric, however, in certain instances the ridges are oriented at an angle of about 5 degrees relative to the machine direction axis. In those instance where the ridges are angled relative to the machine direction axis, they may be woven so as to regularly reverse direction in terms of movement in the cross-machine direction, creating a wavy appearance which can enhance aesthetics of the resulting tissue product. While the ridges could be angled with respect to the machine direction axis, the degree of orientation is limited. Moreover, the ridges could not be woven to a have a height that was substantially continuous along their length.

Thus, the prior art woven papermaking fabrics have generally been limited to topographies oriented substantially in the machine direction, with some small degree of variability. Machine direction oriented topography presents several problems primarily in fabric manufacturing and in limitations in aesthetic appearances that can be created. Machine direction oriented topography often relies upon warp filaments to form machine direction oriented ridges with fewer interchanges than warp filaments in the adjacent valleys causing differences in warp tension. The tension differences often result in the ridges of the fabric becoming slack and ceasing to weave. Once a warp filament ceases to weave into the fabric, they become so slack that they are in danger of being broken by the projectile of the loom. Thus, there remains a need in the art for a new weave structure to address the limitations of current weave structures for woven paper machine clothing.

SUMMARY

The present inventors have now discovered new weave patterns for the manufacture of woven papermaking fabrics that allow the web contacting surface of the fabric to be woven with three-dimensional topography comprising protuberances that are oriented at an angle relative to both the machine direction (MD) axis and cross-machine (CD) axis of the fabric. The protuberances may be discrete or continuous and, in certain preferred embodiments, intersect one another to form discrete valleys there between.

Accordingly, in one embodiment the present invention provides a woven papermaking fabric comprising a first plurality of machine direction (MD) oriented protuberances and a second plurality of cross-machine direction (CD) oriented protuberances, wherein at least one of the first plurality of MD oriented protuberances intersects at least one of the second plurality of CD oriented protuberances. Preferably both the MD and CD oriented protuberances have a non-zero element angle and more preferably both the MD and CD oriented protuberances are woven in a twill pattern. In particular instances the first plurality of protuberances may be non-zero, such as from about 0.5 to about 20 degrees, such as from about 2.0 to about 15 degrees, such as from about 5.0 to about 10 degrees. The second plurality of protuberances may have an element angle from about 60 to about 85 degrees, such as from about 65 to about 80 degrees, such as from about 70 to about 75 degrees.

In another embodiment the present invention provides a woven papermaking fabric having a web contacting surface and an opposed machine contacting surface, the web contacting surface comprising a first plurality of spaced apart, parallel MD oriented protuberances having an element angle from about 2.0 to about 10 degrees and a second plurality of spaced apart, parallel CD oriented protuberances having an element angle from about 65 to about 75 degrees, wherein the first and second plurality of protuberances intersect one another and define a plurality of valleys there between. In certain instances the protuberances may be woven so as to provide valleys having relatively steep sidewalls, such as wall angles greater than about 20 degrees and more preferably greater than about 22 degrees and still more preferably greater than about 24 degrees, such as form about 20 to about 45 degrees and more preferably from about 22 to about 40 degrees. In addition to having relatively steep wall angles, the woven fabrics have valleys that provide superior fiber support and uniformity in pore size.

In yet other embodiments the present invention provides a woven papermaking fabric having a machine direction axis and a cross-machine direction axis, the fabric comprising a plurality of machine direction (MD) oriented warp filaments and a plurality of cross-machine direction (CD) oriented shute filaments, the shute filaments being interwoven with warp filaments to provide a machine contacting fabric side and opposed web contacting fabric side, the web contacting fabric side having a plurality of MD oriented protuberances woven from two or more warp filaments and a plurality of CD oriented protuberances woven from two or more shute filaments, wherein the MD and CD oriented protuberances intersect one another and define a plurality of valleys there between.

The MD oriented protuberances may be woven from two, three, four or more warp filaments that are staggered by two or more shute filaments, but overlap to some degree. The warp filaments forming a MD protuberance can vary in length, but typically rise over from about five to about forty shute filaments, such as from about ten to about thirty shute filaments, depending on the size and spacing of the shute filaments. The extent to which warp filaments forming a given MD protuberance overlap each may vary. For example, the outermost warp filaments forming a protuberance may overlap each other from two to ten shute filaments and more preferably from about three to eight shute filaments, allowing the end of one warp float to tuck under the directly adjacent machine direction oriented warp float. In this manner the weave pattern yields MD protuberances comprising warp stacks with a degree of symmetry where warps are introduced and ended in uniform spacing. Further, the weave pattern may yield MD protuberances having a twisted rope appearance that provides stable protuberances having good height and sidewall angles and is visually appealing.

In other instances the MD protuberances may be woven from two or more machine direction oriented warp filaments, such as from two to eight warp filaments or four to six warp filaments, woven to form a protuberance on the web contacting surface where the distal end of a first warp float and the proximal end of an adjacent warp float overlap one another a distance of two to ten shute filaments and more preferably from about three to eight shute filaments.

The CD oriented protuberances may be woven from two, three, four or more shute filaments that are staggered by two or more warp filaments, but overlap to some degree. The shute filaments forming a CD protuberance can vary in length, but typically rise over from about five to about forty, such as from about ten to about thirty warp filaments, depending on the size and spacing of the shute filaments. The extent to which shute filaments forming a given CD protuberance overlap each may vary. For example, the outermost shute filaments forming a CD protuberance may overlap each other from two to ten warp filaments and more preferably from about three to eight warp filaments, allowing the end of one shute float to tuck under the directly adjacent cross-machine direction oriented shute float. In this manner the weave pattern yields CD protuberances comprising shute stacks with a degree of symmetry where shutes are introduced and ended in uniform spacing. Further, the weave pattern may yield CD protuberances having a twisted rope appearance that provides stable protuberance having good height and sidewall angles and is visually appealing.

In other instances the CD protuberances may be woven from two or more cross-machine direction oriented shute filaments, such as from two to eight shute filaments or four to six shute filaments, woven to form a CD protuberance on the web contacting surface where the distal end of a first shute float and the proximal end of an adjacent shute float overlap one another a distance of two to ten warp filaments and more preferably from about three to eight warp filaments.

DEFINITIONS

Figure 1:
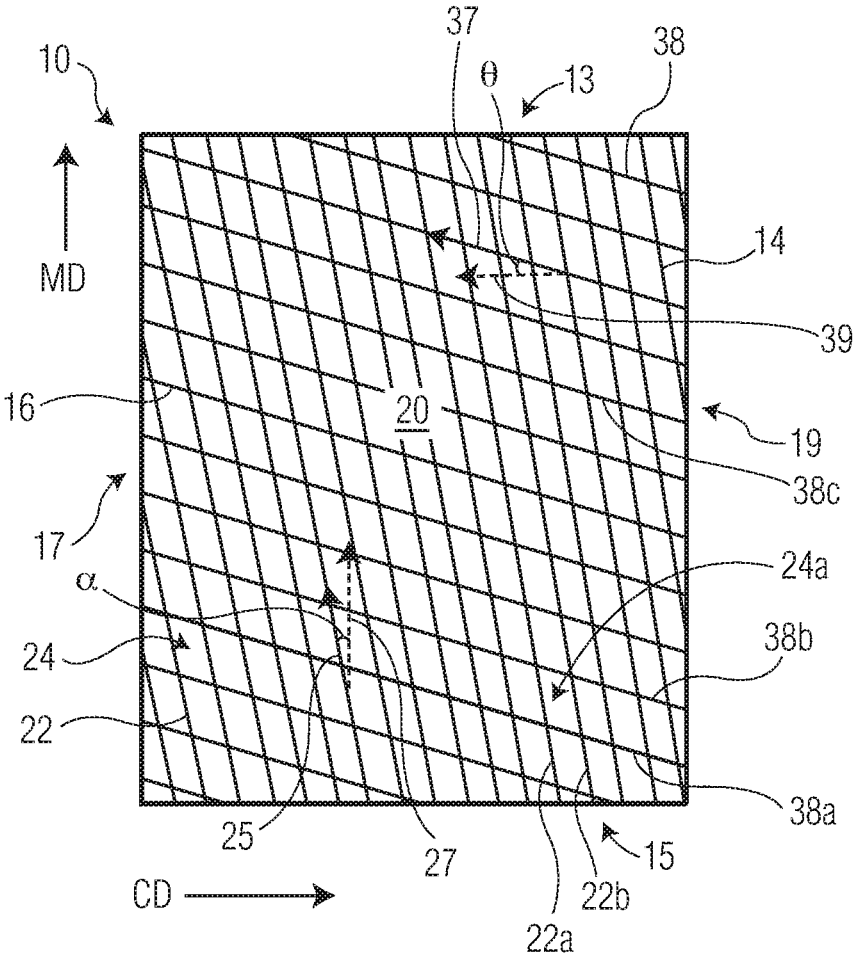
FIG. 1 is a top view of a woven papermaking fabric having a three-dimensional fabric contacting surface according to one embodiment of the present invention.

As used herein, the term "tissue product" refers to products made from tissue webs and includes, bath tissues, facial tissues, paper towels, industrial wipers, foodservice wipers, napkins, medical pads, medical gowns, and other similar products. Tissue products may comprise one, two, three or more plies.

As used herein, the terms "tissue web" and "tissue sheet" refer to a fibrous sheet material suitable for forming a tissue product.

As used herein, the term "papermaking fabric" means any woven fabric used for making a cellulosic web such as a tissue sheet, either by a wet-laid process or an air-laid process. Specific papermaking fabrics within the scope of this invention include forming fabrics; transfer fabrics conveying a wet web from one papermaking step to another, such as described in U.S. Pat. No. 5,672,248; as molding, shaping, or impression fabrics where the web is conformed to the structure through pressure assistance and conveyed to another process step, as described in U.S. Pat. No. 6,287,426; as creping fabrics as described in U.S. Pat. No. 8,394,236; as embossing fabrics as described in U.S. Pat. No. 4,849,054; as a structured fabric adjacent a wet web in a nip as described in U.S. Pat. No. 7,476,293; or as through-air drying fabrics as described in U.S. Pat. Nos. 5,429,686, 6,808,599 B2 and 6,039,838. The fabrics of the invention are also suitable for use as molding or air-laid forming fabrics used in the manufacture of non-woven, non-cellulosic webs such as baby wipes.

Fabric terminology used herein follows naming conventions familiar to those skilled in the art. For example, as used herein the term "warps" generally refers to machine direction filaments and the term "shutes" generally refers to cross-machine direction filaments, although it is known that fabrics can be manufactured in one orientation and run on a paper machine in a different orientation.

As used herein, the term "directly adjacent" when referring to the relation of one filament to another means that no other filaments are disposed between the referenced filaments. For example, if two warp filaments forming a portion of a protuberance are said to be directly adjacent to one another no other warp filaments are disposed between the two protuberance forming warp filaments.

As used herein, the term "protuberance" generally refers to a three-dimensional element formed either by one or more warp filaments overlaying a plurality of shute filaments or by one or more shute filaments overlaying a plurality of warp filaments. Protuberances may be referred to herein alternatively as three-dimensional elements or simply as elements.

As used herein, the term "protuberance forming portion" refers to warp or shute filaments that form a portion of the protuberance. For example, the protuberance forming portion of a MD oriented protuberance may comprise a plurality of adjacent warp/shute filament interchanges that are woven such that the warp filaments are woven above their respective shute filaments.

As used herein, the term "valley" generally refers to a portion of the web contacting surface of the papermaking fabric lying between adjacent protuberances.

As used herein, the "valley bottom" is defined by the top of the lowest visible filament which a tissue web can contact when molding into the textured, fabric. The valley bottom can be defined by a warp knuckle, a shute knuckle, or by both. The "valley bottom plane" is the z-direction plane intersecting the top of the elements comprising the valley bottom.

As used herein, the term "valley depth" generally refers to z-directional depth of a given valley and is the difference between C2 (95 percentile height) and C1 (5 percentile height) values, having units of millimeters (mm), as measured by profilometry and described in the Test Method section below. In certain instances valley depth may be referred to as S90. To determine valley depth a profilometry scan of a fabric is generated as described herein, from which a histogram of the measured heights is generated, and an S90 value (95 percentile height (C2) minus the 5 percentile height (C1), expressed in units of mm) is calculated. Generally the instant fabrics have relatively deep valleys, such as valleys having valley depths greater than about 0.30 mm, more preferably greater than about 0.35 mm and still more preferably greater than about 0.40 mms, such as from about 0.30 to about 1.0 mm.

As used here, the term "valley width" generally refers to the width of a valley disposed on a fabric according to the present invention and is the Psm value, having units of millimeters (mm), as measured by profilometry and described in the Test Method section below. Generally valley width is measured along a line drawn normal to the machine direction axis of the fabric that intersects at least two adjacent MD oriented protuberances. The valley width of a given fabric may vary depending on the weave pattern, however, in certain instances the valley width may be greater than about 1.0 mm, more preferably greater than about 1.5 mm and still more preferably greater than about 2.0 mm, such as from about 2.0 to about 5.0 mm.

As used herein, the term "element angle" generally refers to the orientation of a protuberance along its longitudinal axis relative to the MD axis of the fabric. Element angle is generally measured by profilometry and described in the Test Method section below.

As used herein, the term "wall angle" generally refers to the angle formed between a given valley bottom and an adjacent machine direction (MD) oriented protuberance and is the Pdq value, having units of degrees (°), as measured by profilometry and described in the Test Method section below. Generally wall angle is measured along a line drawn normal to the machine direction axis of the fabric that intersects at least two adjacent MD oriented protuberances. The instant fabrics may have MD oriented protuberances with relatively steep wall angles, such as wall angles greater than about 20 degrees and more preferably greater than about 22 degrees and still more preferably greater than about 24 degrees, such as from about 20 to about 45 degrees and more preferably from about 22 to about 40 degrees.

As used herein the term "discrete" when referring to an element of a papermaking fabric according to the present invention, such as a valley, means that the element is visually unconnected from other elements and does not extend continuously in any dimension of the papermaking fabric surface.

As used herein, the term "discrete protuberance" refers to separate, unconnected three-dimensional elements disposed on a papermaking fabric that do not extend continuously in any dimension of the fabric. A protuberance may be discrete despite being formed from a single continuous filament. For example, a single continuous warp filament may be woven such that it forms a plurality of discrete machine direction oriented protuberances where each protuberance has a float proximal end and a float distal end where the ends of the protuberance terminate at spaced apart shute filaments.

As used herein the term "continuous" when referring to a three-dimensional element of a papermaking fabric according to the present invention, such as a protuberance or a pattern, means that the element extends throughout one dimension of the papermaking fabric surface. When referring to a protuberance the term refers to a protuberance comprising two or more warp filaments that extend without interruption throughout one dimension of the woven fabric.

As used herein, the term "uninterrupted" generally refers to a protuberance having an upper surface plane that extends without interruptions and remains above the valley bottom plane for the length of the protuberance. Undulations of the upper surface plane within a protuberance along its length such as those resulting from twisting of warp filaments or warp filaments forming the protuberance tucking under one another are not considered to be interruptions.

As used herein the term "line element" refers to a three-dimensional element of a papermaking fabric, such as a protuberance, in the shape of a line, which may be continuous, discrete, interrupted, and/or a partial line with respect to a fabric on which it is present. The line element may be of any suitable shape such as straight, bent, kinked, curled, curvilinear, serpentine, sinusoidal, and mixtures thereof. In one example, a line element may comprise a plurality of discrete elements that are oriented together to form a visually continuous line element.

As used herein the term "pattern" refers to any non-random repeating design, figure, or motif. Generally the fabrics of the present invention may comprise decorative patterns comprising a plurality of line elements, however, it is not necessary that the line elements form recognizable shapes, and a repeating design of the line elements is considered to constitute a decorative pattern.

As used herein the term "twill pattern" generally refers to a pattern of continuous, parallel, spaced apart MD or CD oriented protuberances having a non-zero element angle. In a twill pattern the MD oriented protuberances are woven from two or more directly adjacent warp filaments having a paired portion having a float length from 2 to 8 and the CD oriented protuberances are woven from two or more directly adjacent shute filaments having a paired portion having a float length from 2 to 8.

DETAILED DESCRIPTION

The present inventors have now surprisingly discovered that certain woven papermaking fabrics, and in particular woven transfer and through-air drying (TAD) fabrics, having patterns disposed thereon that may be used to produce tissue webs and products having high bulk and visually appealing aesthetics without compromising operating efficiency. Papermaking fabrics of the current invention are generally directed to woven fabrics but may be suitable as base fabrics upon which to add additional material to enhance tissue physical properties or aesthetics. For example, the instant woven fabrics may be used in the manufacture of a papermaking fabric having a foraminous woven base member surrounded by a hardened photosensitive resin framework. In other instances the instant woven fabrics may be used in the manufacture of a papermaking fabric having a foraminous woven base member with a polymeric material disposed thereon by printing, extruding or well-known additive manufacturing processes.

The present fabrics may be used in the manufacture of a broad range of fibrous structures, particularly wet-laid fibrous structures and more particularly, wet-laid tissue products such as bath tissues, facial tissues, paper towels, industrial wipers, foodservice wipers, napkins and other similar products. Further, the inventive fabrics are well suited for use in a wide variety of tissue manufacturing processes. For example, the fabrics may be used as TAD fabrics in either uncreped or creped applications to generate aesthetically acceptable patterns favorable tissue product physical properties. Alternatively, the fabrics may be used as impression fabrics in wet-pressed papermaking processes.

Accordingly, in one embodiment, the invention resides in a woven papermaking fabric having a machine direction (MD) axis and a cross-machine direction (CD) axis, a machine contacting surface and a sheet contacting surface where the sheet contacting surface is textured and comprises a first plurality of protuberances oriented at an angle relative to the MD axis of the fabric and a second plurality of protuberances oriented at an angle relative to the CD axis. The first and second plurality of protuberances intersect one another and define a plurality of discrete valleys there between.

The first protuberances are generally MD oriented and have a non-zero element angle, such as an element angle greater than about 0.5 degrees, such as from about 0.5 to about 20 degrees, and more preferably from about 2.0 to about 15 degrees and still more preferably from about 5.0 to about 10 degrees. One skilled in the art will appreciate that in other instances the inventive fabrics may also be woven such that the first protuberances have a negative element angle, such as an element angle from about −20 to about −0.5, more preferably from about −15 to −2.0 degrees and still more preferably from about −10 to about −5.0 degrees.

The second protuberances are generally CD oriented and have a non-zero element angle, such as an element angle greater than about 60 degrees, such as from about 60 to about 85 degrees, such as from about 65 to about 75 degrees. One skilled in the art will appreciate that in other instances the inventive fabrics may also be woven such that the second protuberances have an element angle from about −60 to −85 degrees, such as from about −65 to about −75 degrees.

The first plurality of protuberances, which are generally oriented in the MD and may be referred to herein as MD oriented protuberances, generally comprise two or more directly adjacent warp filaments supported by a shute strand. For example, two, three, four or more warp filaments may be combined to form a MD protuberance, also referred to as a three-dimensional element or simply as a line element, on the web contacting surface of the fabric. Accordingly, in certain embodiments a MD protuberance may comprise from two or more warp filaments, such as from two to six warp filaments that are woven above their corresponding shute filaments.

The warp filaments forming the MD protuberances may extend substantially in the machine direction and extend over at least two shute filaments in the machine direction, or at least four shute filaments, or at least six shute filaments, such as from about two to about ten shute filaments. When referring to the number of shute filaments traversed by the warp filaments forming a given element the term "float length" will be used. For example, a warp filament forming a MD protuberance that extends substantially in the machine direction over five shute filaments is said to have a float length of five.

The two or more warp filaments forming the MD protuberances may be woven such that they are laterally offset from one another in the machine direction. In this manner the distal end of a first warp filament and the proximal end of a directly adjacent warp filament overlap to an extent to form a paired portion. The paired portion may have a float length from two to ten and more preferably from three to eight. Weaving the warp filaments in this paired, offset manner allows the end of one warp float to tuck under the next machine direction oriented warp float. As a result the weave pattern yields MD protuberances comprising warp stacks with a degree of symmetry where warps are introduced and ended in uniform spacing.

The warp filaments may be woven to form MD protuberances that form a twill pattern that extends in a continuous manner across the fabric. The twill pattern is formed from parallel MD protuberances having a principal axis that while generally oriented in the machine direction (MD) is slightly skewed relative to the machine direction axis to provide a non-zero element angle, such as an element angle from about 0.5 to about 20 degrees. Between adjacent MD protuberances are valleys, which may be oriented at an angle relative to the machine direction axis like the MD protuberances that bound them. In a particularly preferred embodiment the MD protuberances forming the twill pattern are linear and provide valleys having linear sidewalls.

The first plurality of protuberances are intersected by a second plurality of protuberances, which are generally oriented in the cross-machine (CD) direction. Generally the CD oriented protuberances comprise two or more directly adjacent shute filaments supported by a corresponding warp strand. For example, two, three, four or more shute filaments may be combined to form a CD protuberance. Accordingly, in certain embodiments a CD protuberance may comprise from two or more shut filaments, such as from two to six shute filaments that are woven above their corresponding warp filaments.

The shute filaments forming the CD protuberance may extend substantially in the cross-machine direction and extend over at least two warp filaments in the cross-machine direction, or at least four warp filaments, or at least six warp filaments, such as from about two to about ten warp filaments. In this manner the shute filament forming the CD protuberance may have a float length from about two to ten, such as from about two to six.

The two or more shute filaments forming the CD protuberance may be woven such that the distal end of a first shute filament and the proximal end of a directly adjacent shute filament overlap to an extent to form a paired portion. The paired portion may have a float length from two to ten, such as from about preferably from three to eight.

Like the first MD oriented protuberances, the second CD oriented protuberances may be woven in a twill pattern that extends in a continuous manner across the fabric. For example, the fabric may be woven such that the CD oriented protuberances are parallel and spaced apart from one another and slightly skewed relative to the cross-machine direction axis to provide a non-zero element angle, such as an element angle greater than about 60 degrees, such as from about 60 to about 85 degrees, such as from about 65 to about 75 degrees.

Generally the CD oriented protuberances intersect the MD oriented protuberances and together the protuberances define valleys there between. In this manner the MD oriented protuberances may form the valley sidewalls and the CD oriented protuberances may form the valley end walls. In certain instances, such as when the instant papermaking fabrics are used as a through-air drying fabric, the fibers of the embryonic tissue web are deflected in the z-direction by the protuberances and are disposed along the valley plane to yield a web having a three-dimensional topography. The valleys generally have a valley bottom that lies below the upper surface of the MD and CD oriented protuberances. Preferably the valleys are permeable to both liquid and air and facilitate the rapid transportation of both through the embryonic tissue web supported thereon as it is transported through the tissue making process.

While in certain embodiments the first and second protuberances are generally in the form of straight or substantially straight lines arranged in parallel with a single element angle, the invention is not so limited. In other embodiments the protuberances may have a curvilinear shape and a given protuberance may comprise segments having more than one axis of orientation and more than one element angle. Despite having segments with different element angles a given curvilinear protuberance generally has a major axis that is machine direction oriented.

In a particularly preferred embodiment the first and second protuberances are arranged in a continuous twill pattern, extending from a first lateral edge of the fabric to a second lateral edge, in which adjacent protuberances are generally parallel to one another. The twill woven MD oriented protuberances may have an element angle from about 10 to about 15 degrees and the CD oriented protuberances may have an element angle from about 65 to about 75 degrees. Of course, the directions of the protuberance alignments refer to the principal alignment of the protuberances. Within each alignment, the protuberance may have segments aligned at other directions, but aggregate to yield the particular alignment of the entire protuberance. Further, while in the instant embodiment the protuberances are continuous, in other embodiments the protuberances may be discrete.

If a papermaking fabric includes multiple protuberances it is contemplated that a plurality of, or all of, the protuberances can be configured substantially the same in terms of any one or more of characteristics of height, width, or length. It is also contemplated that a papermaking fabric can be configured with protuberances configured such that one or more characteristics of height, width, or length of the protuberances vary from one protuberance to another protuberance. In certain embodiments substantially all MD oriented protuberances have substantially similar characteristics of height, width, or length, which may be different, or the same as, the characteristics of the CD oriented protuberances.

Figure 2:
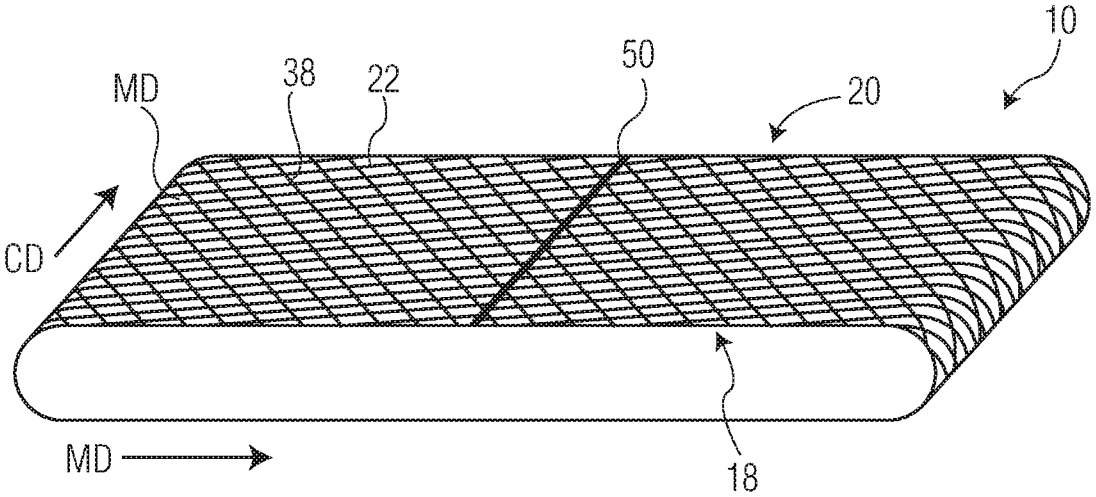
FIG. 2 illustrates the woven papermaking fabric of FIG. 1 in seamed configuration.

With reference now to FIGS. 1 and 2, one embodiment of a papermaking fabric according to the present invention is illustrated. The fabric 10 has two principal dimensions a machine direction ("MD"), which is the direction within the plane of the fabric 10 parallel to the principal direction of travel of the tissue web during manufacture and a cross-machine direction ("CD"), which is generally orthogonal to the machine direction. The papermaking fabric can include a first longitudinal end 13 and a second longitudinal end 15 that can be joined to form a seam 50 as shown in FIG. 2.

The papermaking fabric generally comprises a plurality of filaments that can be woven together. As will be described in further detail below, the filaments can include a plurality of warp filaments 14 and a plurality of shute filaments 16 that can be woven together to form a machine contacting surface 18 and a web contacting surface 20 of the woven papermaking fabric 10. The web contacting surface 20 can be opposite from the machine contacting surface 18. Machinery employed in a typical papermaking operation is well known in the art and may include, for example, vacuum pickup shoes, rollers, and drying cylinders. In a preferred embodiment, the papermaking fabric comprises a through-air drying fabric useful for transporting an embryonic tissue web across drying cylinders during the tissue manufacturing process. However, in other embodiments, the woven papermaking fabric can comprise a transfer fabric for transporting an embryonic tissue web from forming wires to a through-air drying fabric. In these embodiments, the web contacting surface supports the embryonic tissue web, while the opposite surface, the machine contacting surface, contacts the surrounding machinery.

The web contacting surface 20 of the fabric 10 comprises a first plurality protuberances 22, which are generally oriented in the MD of the fabric. The first protuberances 22 are generally disposed on the web-contacting surface 20 for cooperating with, and structuring of, the wet fibrous web during manufacturing. In a particularly preferred embodiment the web contacting surface 20 comprises a plurality of spaced apart three-dimensional first protuberances 22 distributed across the web-contacting surface 20 of the fabric 10 and together constituting from at least about 15 percent of the projected surface area of the web contacting surface of the fabric, such as from about 15 to about 35 percent, more preferably from about 18 to about 30 percent, and still more preferably from about 20 to about 25 percent.

The first protuberances 22, such as those illustrated in FIG. 1, may extend generally in a first direction along a major axis 25 across one dimension of the fabric 10 in a continuous fashion. In this manner a protuberance 22 may extend from a first longitudinal edge 13 of the fabric 10 to a second longitudinal edge 15. In such embodiments the length of the protuberance is dependent upon the length of the fabric 10 and the angle of the protuberance relative to the MD axis of the fabric. For example, the first protuberances 22*a*-22*c* may be arranged in a parallel fashion and extend along a major axis 25 at an angle (a) relative to the machine direction axis 27. In this manner the first protuberances 22 generally have a long direction axis, i.e., the major axis 25, that intersects the machine direction axis 27 to form an element angle (a), which is preferably greater than about 0.5 degrees, and more preferably greater than about 2.0 degrees and still more preferably greater than about 5.0 degrees, such as from about 0.5 to about 20 degrees and more preferably from about 2.0 to about 15.0 degrees and still more preferably from about 5.0 to about 10.0 degrees. While the illustrated MD oriented protuberances are arranged in a parallel fashion and have the same element angle, the invention is not so limited. In other embodiments the element angle may vary amongst the MD oriented protuberances.

The web contacting surface 20 of the fabric 10 further comprises a second plurality of protuberances 38 that are oriented in the cross-machine direction (CD) of the fabric. The second protuberances 38 are generally disposed on the web contacting surface 20 for cooperating with, and structuring of, the wet fibrous web during manufacturing. In a particularly preferred embodiment the web contacting surface 20 comprises a plurality of spaced apart three-dimensional second protuberances 38 distributed across the web contacting surface 20 of the fabric 10 and together constituting from at least about 15 percent of the projected surface area of the web contacting surface of the fabric, such as from about 15 to about 35 percent, more preferably from about 18 to about 30 percent, and still more preferably from about 20 to about 25 percent.

The second protuberances 38, such as those illustrated in FIG. 1, may extend generally in a first direction along a major axis 37 across one dimension of the fabric 10 in a continuous fashion. In this manner a second protuberance 38 may extend from a first lateral edge 17 of the fabric 10 to a second lateral edge 19. In such embodiments the length of the protuberance is dependent upon the width of the fabric 10 and the angle of the protuberance relative to the cross-machine direction (CD) axis 39. For example, the second protuberances 38*a*, 38*b* may be spaced apart and parallel to one another and extend along a major axis 37 at an angle (θ) relative to the CD axis 39. In this manner the second protuberances 38 generally have a long direction axis, i.e., the major axis 37 that intersects CD axis 39 to form an element angle (θ), which may be greater than about 60 degrees, such as from about 60 to about 85 degrees, such as from about 65 to about 75 degrees. While the illustrated CD oriented protuberances are arranged in a parallel fashion and have the same element angle, the invention is not so limited. In other embodiments the element angle may vary amongst the CD oriented protuberances.

With continued reference to FIG. 1, the web contacting surface 20 may comprises a plurality of valleys 24, which are generally bounded by first and second protuberances 22, 38. For example, with reference to valley 24*a*, the sidewalls are formed from spaced apart first protuberances 22*a*, 22*b* and the end walls are formed from spaced apart second protuberances 38*a*, 38*b*. In this manner the valleys are generally discrete.

The valleys 24 are formed from interwoven warp and shute filaments 14, 16 and are generally permeable to liquids and allow water to be removed from the cellulosic tissue web by the application of differential fluid pressure, by evaporative mechanisms, or both when drying air passes through the embryonic tissue web while on the papermaking fabric 10, or a vacuum is applied through the fabric 10. Without being bound by any particularly theory, it is believed that the arrangement of protuberances and valleys allow the molding of the embryonic web causing fibers to deflect in the z-direction and generate the caliper of, and patterns on the resulting tissue web. In certain instances the valleys may be a predominate feature on the fabric surface and may comprise greater than about 50 percent, more preferably greater than about 55 percent, such as from about 50 to about 75 percent of the projected area of the web contacting surface of the fabric.

In a particularly preferred embodiment, such as that illustrated in FIG. 1, both the first plurality of MD oriented protuberances 22 and the second plurality of CD oriented protuberances 38 are woven in a twill pattern. In this manner the first and second protuberances 22, 38 intersect one another at regular intervals. Further each of the first and second protuberances 22, 38 may be woven such that they are substantially similar in terms of size and shape and provide the web contacting surface 20 of the fabric 10 with a relatively uniform three-dimensional pattern.

The spacing and arrangement of protuberances may vary depending on the desired tissue product properties and appearance. If the individual protuberances are too high, or the valley area is too small, the resulting sheet may have excessive pinholes and insufficient compression resistance, CD stretch, and CD Tensile Energy Absorption (TEA), and be of poor quality. Further, tensile strength may be degraded if the span between protuberances greatly exceeds the fiber length. Conversely, if the spacing between adjacent protuberances is too small the tissue will not mold into the valleys without rupturing the sheet, causing excessive sheet holes, poor strength, and poor paper quality.

For example, the spacing and arrangement of protuberances may be arranged so as to provide fabrics having a relatively large percentage of fabric contacting surface formed from valleys disposed between adjacent MD and CD oriented protuberances. For example, in certain embodiments the valleys may comprise more than 50 percent of the projected surface area of the web contacting surface of the fabric. To achieve a relatively high degree of surface coverage the valleys may have a width, generally measured using profilometry as described herein, greater than about 1.0 mm, more preferably greater than about 1.5 mm and still more preferably greater than about 2.0 mm, such as from about 1.5 to about 3.5 mm. Of course, it is contemplated that the width can be outside of the preferred range in some embodiments and still be within the scope of this disclosure.

While in certain instances it may be desirable to form fabrics where all of the first protuberances are parallel to one another and all of the second protuberances are parallel to one another and each of the protuberances have substantially similar size and shape, the invention is not so limited. In other embodiments the web contacting surface of the fabric may include a plurality of protuberances, wherein two or more protuberances differ in at least one regard to form two or more patterns.

Figure 3:
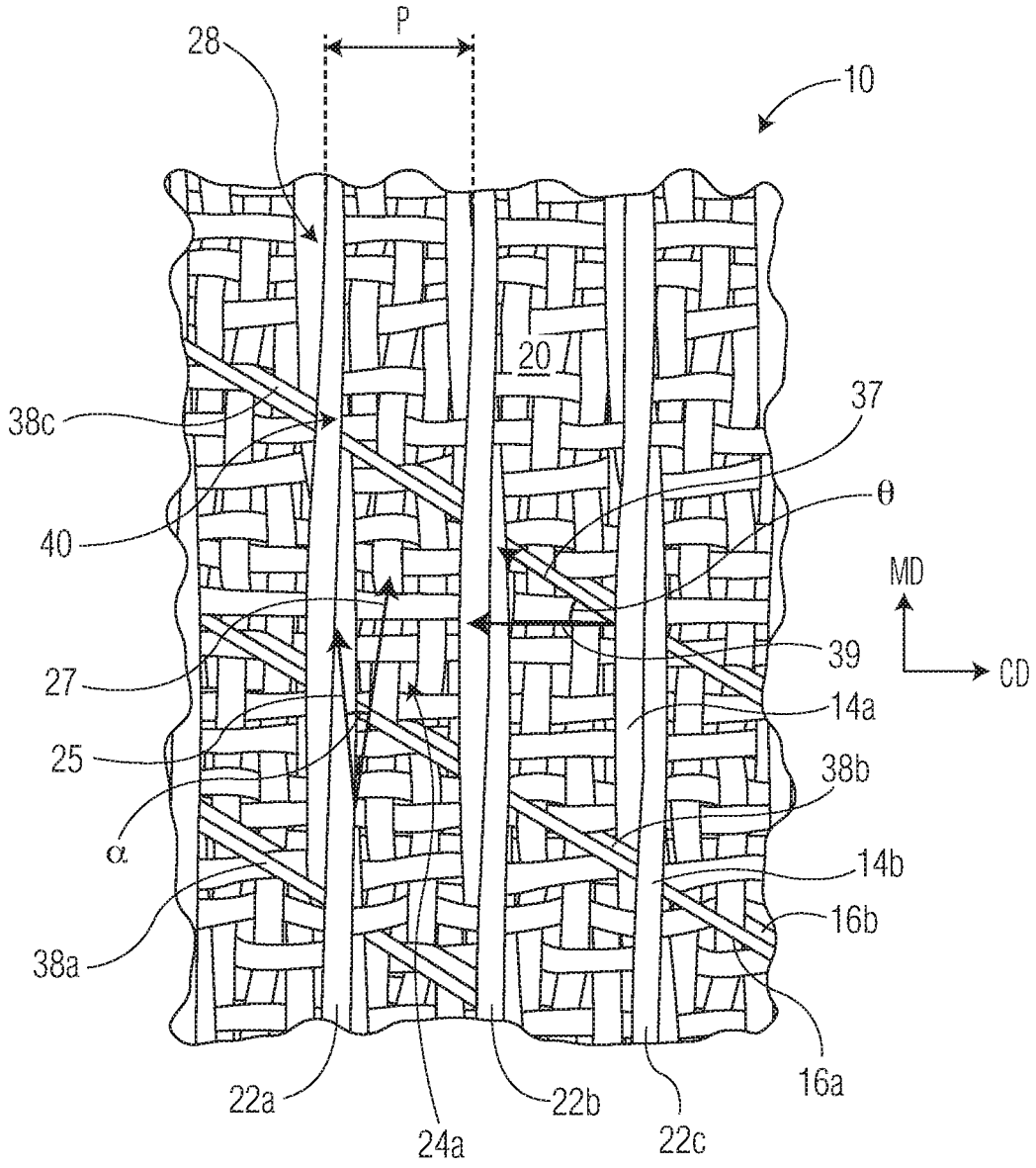
FIG. 3 is a top view of a woven papermaking fabric having a three-dimensional fabric contacting surface according to one embodiment of the present invention.

With reference now to FIG. 3, in the illustrated embodiment, each of the first protuberances 22*a*-22*c* disposed on the web contacting surface 20 are formed from a pair of warp filaments 14*a*, 14*b* woven in a twill pattern. The first protuberances 22*a*-22*c* are arranged generally parallel to one another and extend in a continuous fashion along a first major axis 25, which lies at an element angle (a) relative to the MD axis 27. The first protuberances 22*a*-22*c* comprise the same number and types of warp filaments 14*a*, 14*b* resulting in first protuberances that are similarly sized in terms of width and height.

The height of the first protuberance may be varied depending on the desired degree of molding and the resulting tissue product properties. The first protuberance height may range from about 0.1 to about 5.0 mm, more preferably from about 0.2 to about 3.0 mm, or even more preferably from about 0.5 to about 1.5 mm. One skilled in the art will appreciate that the height of the protuberances may be altered by selecting warp filaments of different sizes and shapes and by the number of warps forming a given protuberance. Of course, it is contemplated that the height can be outside of this preferred range in some embodiments. Further, while the height of the protuberances is generally illustrated herein as being substantially uniform amongst the protuberances, the invention is not so limited and the protuberances may have different heights.

The foregoing protuberance heights generally result in fabrics having relatively deep valleys. As illustrated in FIG. 3, adjacent first protuberances 22*a*, 22*b* generally define a valley 24*a* there between with the protuberances 22*a*, 22*b* forming the sidewalls of the valley. The valleys may have a valley depth greater than about 0.30 mm, more preferably greater than about 0.35 mm and still more preferably greater than about 0.40 mms, such as from about 0.30 to about 1.0 mm. Further, in certain instances, the valley walls formed by adjacent protuberances may be relatively steep, such as wall angles greater than about 20 degrees and more preferably greater than about 22 degrees and still more preferably greater than about 24 degrees, such as from about 20 to about 45 degrees and more preferably from about 22 to about 40 degrees.

In the illustrated embodiment the first protuberances 22*a*-22*c* do not have planar sidewalls, but rather are formed from a pair of warp filaments 14*a*, 14*b* that provide the protuberance 22 with a generally semi-circular cross-sectional shape. In other embodiments however, the protuberance may be woven so as to form a pair of opposed sidewalls and provide the protuberance with a rectilinear cross-sectional shape. However, it is to be understood that because the protuberances are formed from woven filaments having generally circular or oval cross-sectional shapes, the cross-sectional shape of the resulting protuberance may not be perfectly rectilinear, but may have some other cross-sectional shape that is approximately rectilinear.

Just as the height and cross-sectional shape of the protuberance may be varied depending on the construction of the fabric, the width of the protuberance may also be varied. For example, the width of the MD oriented protuberances may be influenced by the number of warp filaments used to form the protuberance, as well as the diameter of the filament used for a given warp float. In certain embodiments the MD oriented protuberance may comprise from 2 to 8, such as 4 to 6, warp filaments. In other instances the warp filaments may have a diameter from about 0.2 to about 0.7 mm, such as from about 0.3 to about 0.5 mm and the protuberances may be woven from 2 to 6 adjacent warp filaments. In other examples, the CD oriented protuberances may be woven from shute filaments having a diameter from about 0.2 to about 0.7 mm, such as from about 0.3 to about 0.5 mm and the protuberances may be woven from 2 to 6 adjacent shute filaments.

Protuberance width is generally measured normal to the principal dimension of the protuberance. For example, the width of a MD oriented protuberance may be measured in a plane defined by the cross-machine direction (CD) at a given location. Where the protuberance has a generally square or rectangular cross-section, the width is generally measured as the distance between the two planar sidewalls that form the protuberance. In those cases where the protuberance does not have planar sidewalls the width is measured at the point that provides the greatest width for the configuration of the protuberance. For example, the width of a protuberance not having two planar sidewalls may be measured along the base of the protuberance. In some preferred embodiments, the width of the protuberances may be greater than about 0.5 mm, such as from about 0.5 to about 3.5 mm, more preferably from about 0.5 to about 2.5 mm, such as from about 0.7 to about 1.5 mm. In certain instances the protuberance may have a substantially square cross-sectional area such that the width and height are substantially equal, such as a height and a width from about 1.0 to about 2.0 mm. Of course, it is contemplated that the width can be outside of the preferred range in some embodiments and still be within the scope of this disclosure.

With reference again to FIG. 3, the web contacting surface 20 of the fabric 10 further comprises second protuberances 38, which are generally oriented in the CD and formed from a pair of shute filaments 16*a*, 16*b*. The second protuberances 38*a*, 38*b* are arranged generally parallel to one another and extend in a continuous fashion along a first major axis 37, which lies at an element angle (θ) relative to the CD axis 39. The second protuberances 38*a*, 38*b* comprise the same number and types of shute filaments 16*a*, 16*b* resulting in second protuberances that are similarly sized in terms of width and height.

The second protuberances 38 are formed from a pair of shute filaments 16 that are woven in a twill pattern. The second protuberances 38 intersect the first protuberances 22 and are woven underneath the first protuberances 22 at the point of intersection 40. In this manner, at the point of intersection 40, the first protuberances 22 have an upper surface, generally formed by the upper surface of the warp filament 14 forming the protuberance 22, lying in the upper most surface plane of the fabric 10.

The second protuberances 38, like the first protuberances 22, bound a valley 24. In the illustrated embodiment the second protuberances 38 form the end walls of the valleys 24, resulting in discrete valleys 24 having a parallelogram shape. The valleys 24 generally have valley bottoms formed from interwoven warp and shute filaments 14, 16 and form the lowest web contacting surface of the fabric 10. The upper surface of the second protuberances 38, which are generally formed by the upper surface of the shute filaments 16 forming the protuberances 38, lie in a second fabric surface plane. In certain instances the second fabric surface plane may lie above the valley bottom, but below the upper most surface plane of the fabric 10.

In other embodiments the highest point on the web contacting surface of the fabric may be the upper surface of the CD oriented protuberances, which may lie in a first fabric surface plane. In such embodiments the first fabric surface plane may lie above the surface plane defined by the upper surface of the warp filaments forming the MD oriented protuberances, which may lie in a second fabric surface plane. In such embodiments, the first and second fabric surface planes both lie above the valley bottom plane. In those embodiments where a CD oriented protuberance is formed by a shute filament woven above a warp filament forming a MD oriented protuberance the first fabric surface plane may be at least about 100 μm above the second fabric surface plane, such as from about 100 to about 700 μm above the second fabric surface plane.

In still other embodiments the upper surfaces of the warp and shute filaments forming the MD and CD oriented protuberances may lie substantially in the same surface plane such that the fabric comprises a relatively uniform upper surface plane lying above the valley bottom plane. Where the upper surfaces of the MD and CD oriented protuberances are substantially co-planar, the height difference between the upper surface planes is preferably less than about ±100 μm and more preferably less than about ±75 μm.

In certain embodiments the first or second protuberances may have an upper surface plane which extends uninterrupted for the length of the protuberance resulting in a protuberance having a height that is generally uniform along its length. For example, where a protuberance is continuous and extends throughout one dimension of the papermaking fabric, such as the first protuberance 22 of FIG. 3, its upper surface plane is preferably uninterrupted along the entire length to provide the protuberance a substantially continuous height along its length. While it is generally desirable that the height of a protuberance be substantially constant along its length, slight height variances can be expected as a result of the protuberances being formed from woven filaments. For example, it may be desirable that the height of a given protuberance vary less than ±150 μm and more preferably less than about ±100 μm along its length. To ensure that the height of a given protuberance is substantially constant along its length, it may be preferable to weave the protuberances from one or more warp filaments without weaving a shute filament over the protuberance.

Several exemplary woven papermaking fabrics are illustrated in the attached figures. The illustrated fabrics comprise a web contacting surface having a plurality of MD oriented protuberances intersected by a plurality of CD oriented protuberances. The intersecting protuberances define valleys there between. The illustrated fabrics are useful in the manufacture of tissue products, particularly the manufacture of through-air dried tissue products. The illustrated fabrics generally have valley depths greater than about 0.30 mm, more preferably greater than about 0.35 mm and still more preferably greater than about 0.40 mms, such as from about 0.30 to about 1.0 mm. The fabrics are woven such that the valleys have relatively steep sidewalls, such as a wall angle greater than about 20 degrees and more preferably greater than about 22 degrees and still more preferably greater than about 24 degrees, such as from about 20 to about 45 degrees and more preferably from about 22 to about 40 degrees. The dimensions of various papermaking fabrics prepared according to the present invention are summarized in the table below.

TABLE 1

Figure 4A:
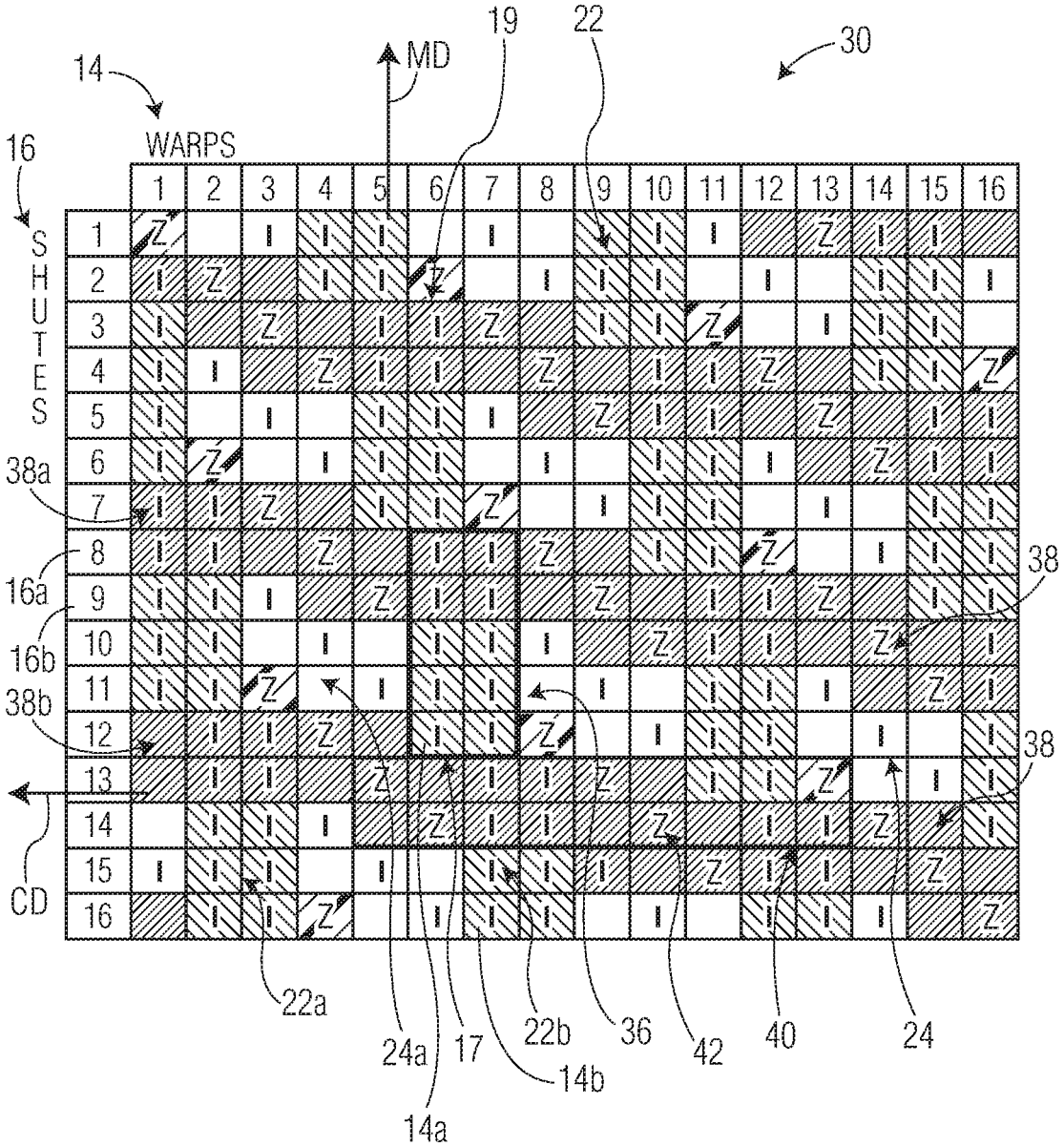
FIG. 4A illustrates one weave pattern useful in the manufacture of a woven papermaking fabric according to the present invention.
Figure 4B:
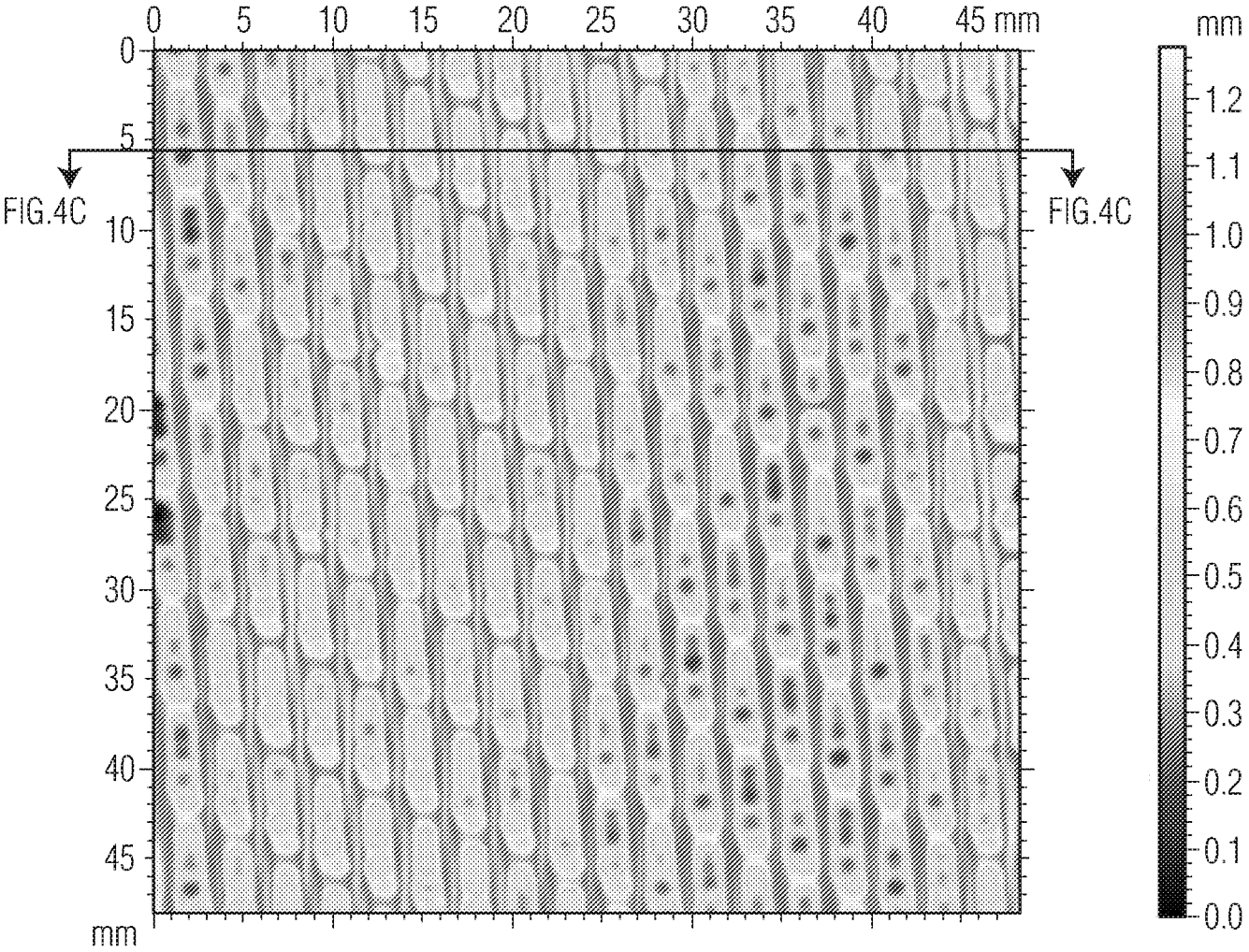
FIG. 4B is a profilometry scan of a fabric woven according to the pattern of FIG. 4A.
Figure 4C:
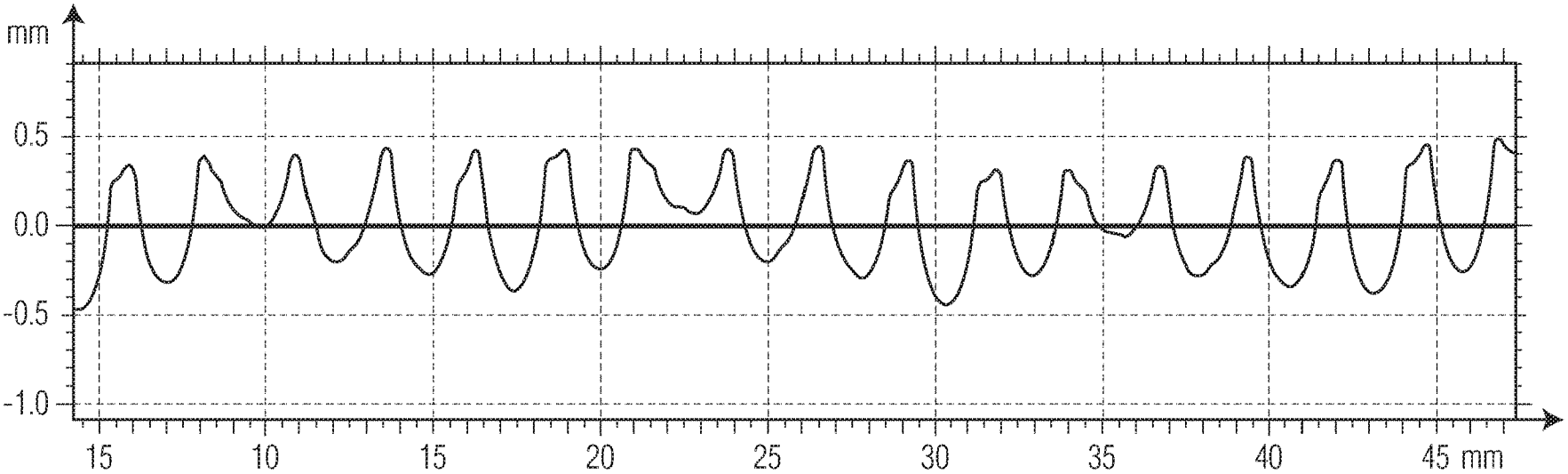
FIG. 4C is a CD profile of a fabric woven according to the pattern of FIG. 4A.

| Illustrated Fabric | Valley Depth (mm) | Wall Angle (°) | Valley Width (mm) | MD Protuberance Element Angle (°) | CD Protuberance Element Angle (°) |
|---|---|---|---|---|---|
| FIG. 4A | 0.789 | 34.3 | 2.80 | −3.0 | −66 |

Exemplary weave patterns and methods of manufacturing a woven papermaking fabric will now be described. In one embodiment, the papermaking fabric could be manufactured by providing a first set of filaments and a second set of filaments that are woven in a weave pattern. The first set of filaments can serve as warp filaments in a loom and the second set of filaments can serve as shute filaments in a loom. The method can additionally include weaving the shute filaments with the warp filaments in a lateral direction to provide a web contacting surface of the woven papermaking fabric and a machine contacting surface of the woven papermaking fabric and to provide a plurality of MD oriented protuberances in a twill pattern and a plurality of CD oriented protuberances in a twill pattern, where the protuberances intersect one another and form valleys there between. Weaving the shute filaments with the warp filaments can be accomplished by following a weave patterns.

One exemplary weave pattern 30 is shown in FIG. 4A. The principles of weave pattern 30 may be adapted to form a broad range of unit cells that may be combined to form various paper making fabrics according to the present invention. The weave pattern 30 can include a plurality of warp filaments 14 generally aligned in the machine direction (MD) and a plurality of shute filaments 16 generally aligned in the cross-machine direction (CD). The weave pattern 30 can be configured on a loom (not pictured) such that the web contacting surface 20 of the papermaking fabric 10 (as labeled in FIG. 2) will be facing out from the page, and the machine contacting surface 18 of the papermaking fabric 10 (as labeled in FIG. 2) will be facing into the page. Of course, it is contemplated that a weave pattern 30 could be configured in the opposite orientation on a loom. Each interchange of a specific warp filament 14 and a specific shute filament 16 of the weave pattern 30 that includes a vertical line segment (or a capital letter "I") provides a notation that the warp filament 14 is above top shute 16 (and above bottom shute 16 if present) at that interchange. For example, the interchange of warp filament No. 1 and shute filament No. 4 includes such a vertical line segment in FIG. 4A and thus, warp filament No. 1 is woven above shute filament No. 4. In some circumstances interchanges of warp filaments 14 and shute filaments 16 that have the vertical line segment (or capital letter "I") that will lead to the development of a protuberances 22 are also shaded with a cross-hatching pattern for purposes of clarity of perceiving the first protuberances 22 of the weave pattern 30 provided herein. In other instances a row in the unit cell contains a square containing a "Z", which indicates that two shutes 16 are represented by the row. A web contacting shute and a machine contacting shute are both represented. The web contacting shute assumes that the interchange containing a "Z" is treated as an I. The machine contacting shute assumes that all interchanges except a "Z" are treated as blank. In still other instances where a specific warp at a given interchange is woven below the top shute 16 (and above bottom shute 16 if present) the pattern 30 is left blank.

The weave pattern 30 is configured with machine direction oriented warp filaments 14 which are woven with cross-machine oriented shute filaments 16 to form first MD oriented protuberances 22. Generally first MD oriented protuberances 22 are continuous areas in the weave pattern 30 in which a plurality of adjacent warp/shute filament interchanges are woven such that the warp filaments 14 are woven above their respective shute filaments 16. Protuberances 22 can be of various lengths and/or widths to provide various shapes. As shown in FIG. 4A, the weave pattern 30 includes a first machine direction oriented protuberance 22*a* which forms a generally linear segment in shape and is spaced apart from a second similarly shaped protuberance 22*b*.

The first and second first protuberances 22*a*, 22*b* are spaced apart from one another and form a valley 24*a* there between. The width of the valley, measured generally in the cross-machine direction, may be from two to ten, such as from three to six, warps wide. In the embodiment illustrated in FIG. 4A the valley 24*a* is three warps wide at its widest point. The valley may comprise a variety of different weave patterns to stabilize the resulting fabric and increase the height of the protuberances. For example, the valley 24*a* of FIG. 4A comprises warp/shute filament interchanges in which the warp filaments 14 are woven both above and below their respective shute filaments 16.

The machine direction (MD) oriented protuberances 22 each comprise a first 14*a* and a second 14*b* warp filament arranged in a pair-wise fashion. The pair-wise warp filaments 14*a*, 14*b* are directly adjacent warps (illustrated as warp positions Nos. 6 and 7) in the weave pattern 30 and comprise a protuberance forming portion in which the warp filament 14*a*, 14*b*, is woven above its respective shute filament. Further, each protuberance forming portion has a float proximal end 17 and float distal end 19 spaced apart in the machine direction (MD). Looking at a specific warp filament 14*a* within the weave pattern 30 in a bottom-to-top fashion, the float proximal end 17 can be the interchange of a specific shute filament and a specific warp filament that begins a series of adjacent interchanges in which the warp filaments are woven above that specific shute filament. The float distal end 19 can be the interchange of a specific shute filament and a specific warp filament that ends a series of adjacent interchanges in which the warp filaments are woven above that specific shute filament. In other words, a shute filament float proximal end can be where the shute filament is woven from a web contacting surface to the machine contacting surface of the fabric and a shute filament float distal end can be where the shute filament is woven from a machine contacting surface to the web contacting surface of the fabric.

As further illustrated in FIG. 4A the weave pattern 30 is configured such that the pair of warp filaments 14*a*, 14*b* overlap one another along an overlap portion 36, outlined by a box, also referred to herein as a "paired portion." The paired portion comprises a portion of the protuberance 22 where both the first and second warp filaments 14*a*, 14*b* are woven above the corresponding shute filament. In the illustrated embodiment the paired portion 36 has a float length of five (traversing shute position Nos. 8-12).

The length of the protuberance forming portions of the warp filaments, that is the portion of a warp filament woven above the shute filaments to form a protuberance, may vary. For example, the warp shutes forming the protuberance may have a float length greater than 4, such as from 4 to 50, more preferably from 5 to 30 and still more preferably from 7 to 20. Further, the vertical, or machine direction, distance between the proximal end of a first protuberance forming portion of a warp filament and the distal end of a second, adjacent, protuberance forming portion of a warp filament may vary in different embodiments. For example, in certain embodiments, float length between the proximal end of a first warp and the distal end of a directly adjacent warp may be from twenty to sixty, such as from twenty-five to fifty.

While the number of shute filaments traversed by a given protuberance forming warp filament may vary, it is generally preferred that the MD oriented protuberances be formed from two or more directly adjacent warp filaments and that the distal end of a first warp filament be offset from the proximal end of a second, adjacent, warp filament so as to form a paired portion. The paired portion preferably has a float length of at least two and more preferably at least three, and still more preferably at least four, such as from two to twenty and more preferably from two to fourteen and still more preferably from four to ten.

With continued reference to FIG. 4A the weave pattern 30 further comprises CD oriented protuberances 38 woven in a twill pattern and comprising a first and a second shute filament arranged in a pair-wise fashion, such as shute filaments 16*a*, 16*b*. The pair-wise shute filaments 16*a*, 16*b* are directly adjacent shutes (illustrated as shute positions Nos. 8 and 9) in the weave pattern 30 and comprise a protuberance forming portion in which the warp filament is woven above its respective shute filament. Further, each protuberance forming portion has a float proximal end and float distal end spaced apart in the cross-machine direction (CD). Looking at a specific shute filament 16*a* within the weave pattern 30 in a left-to-right fashion, the float distal end can be the interchange of a specific shute filament and a specific warp filament that ends a series of adjacent interchanges in which the shute filaments are woven above that specific warp filament, such as the interchange at shute position No. 8 and warp position No. 12. Conversely the float may have a proximal end, which can be the interchange of a specific shute filament and a specific warp filament that begins a series of adjacent interchanges in which the shute filaments are woven above that specific shute filament, such as the interchange at shute position No. 9 and warp position No. 4 for shute filament 16*b*.

Similar to the MD protuberances, the CD protuberance may be formed by weaving shute filaments in a twill pattern. For example, the CD protuberance may be formed from a pair of adjacent shute filaments where the proximal end of a first shute filament and the distal end of an adjacent second shut filament overlap one another along an overlap portion. An exemplary weave pattern 30 in which the CD protuberances 38 are woven in a twill pattern is illustrated in FIG. 4A. Adjacent first and second shute filaments 16*a*, 16*b* are woven above the corresponding warp filament 14 and have overlapping portions forming a paired portion 42. The paired portion 42 comprises a portion of the protuberance 38 where both the first and second shute filaments 16*a*, 16*b* are woven above the corresponding warp filament 14.

The length of the CD protuberance forming portions of the shute filaments, that is the portion of a shute filament woven above the warp filaments to form a CD protuberance, may vary. For example, the shutes forming the CD protuberance may have a float length greater than 4, such as from 4 to 50, more preferably from 5 to 30 and still more preferably from 7 to 20.

Weave pattern 30 comprises MD and CD protuberances 22, 28 that intersect one another and form valleys 24 there between. For example, with continued reference to FIG. 4A, valley 24*a* is bound by spaced apart twill woven CD protuberances 38*a*, 38*b*, which form the valley 24*a* end walls. The valley 24*a* sidewalls are formed from the spaced apart twill woven MD protuberances 22*a*, 22*b*. Because the MD and CD protuberance are woven in a twill pattern the protuberances are skewed relative to the MD and CD axis, respectively, and have a non-zero element angle. The twill woven MD and CD protuberances create valleys that are discrete and generally have a parallelogram shape.

Figure 5A:
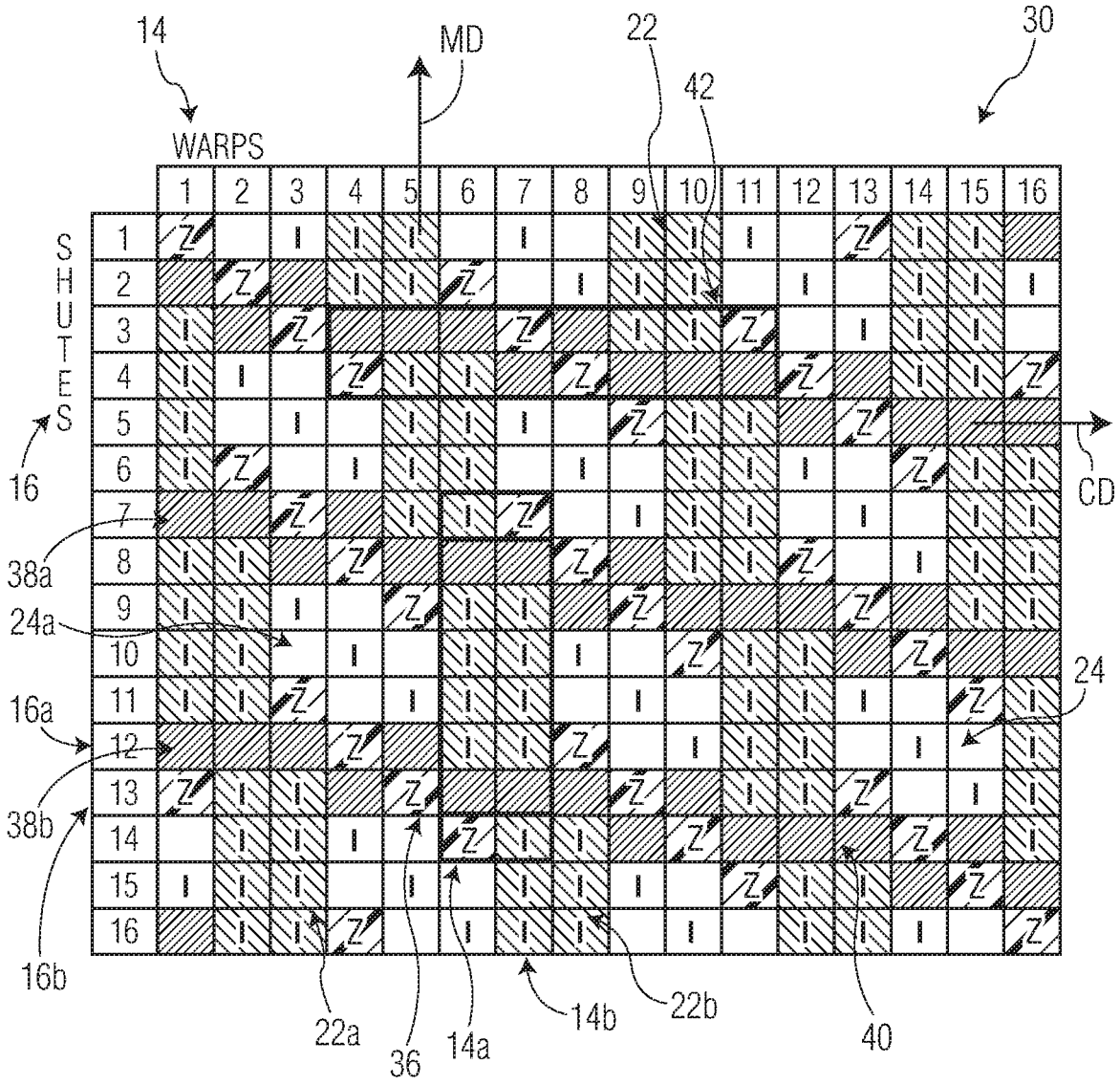
FIG. 5A illustrates one weave pattern useful in the manufacture of a woven papermaking fabric according to the present invention.
Figure 5B:
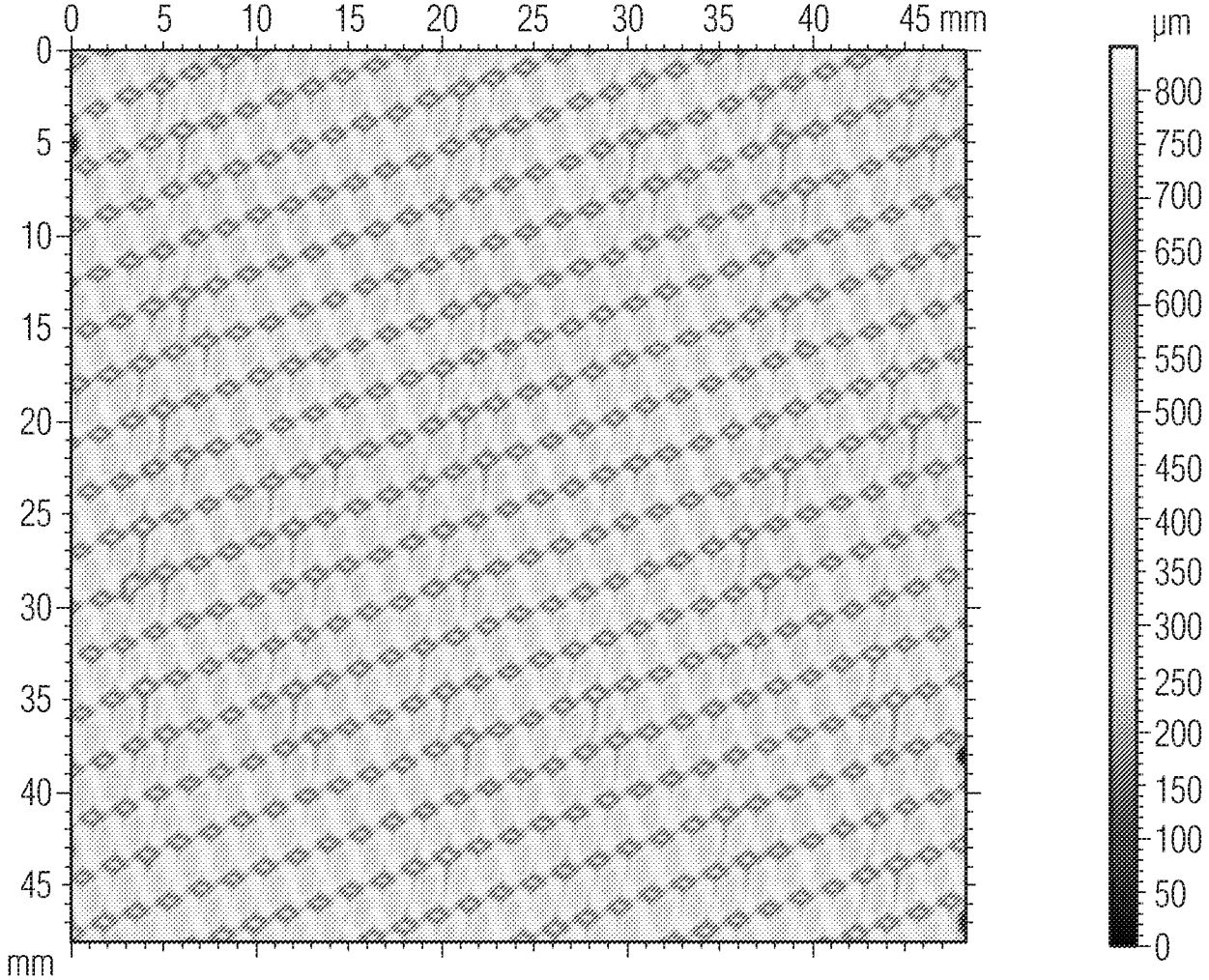
FIG. 5B is a profilometry scan of a fabric woven according to the pattern of FIG. 5A.

With reference now to FIG. 5A an alternative weaving pattern 30 is illustrated. The weave pattern 30 comprises a MD protuberance 22 woven in a twill pattern. The MD protuberance 22 is formed from a pair of adjacent filaments 14*a*, 14*b* each having been woven with interchanges where the warp filament is woven above the corresponding shute filament to provide four protuberance forming portions. Each protuberance forming portion has a float length of 13. Each protuberance forming portion has a proximal end and a distal end. The distal end of a first warp filament and the proximal end of the directly adjacent warp filament overlap to form a paired portion.

The CD protuberances 38 illustrated in the weave pattern of FIG. 5A are also woven in a twill pattern. The CD protuberances, such as protuberance 38*b*, comprise a first and a second shute filament arranged in a pair-wise fashion, such as shute filaments 16*a*, 16*b*. The pair-wise shute filaments 16*a*, 16*b* are directly adjacent shutes (illustrated as shute positions Nos. 12 and 13) in the weave pattern 30 and comprise a protuberance forming portion in which the warp filament is woven above its respective shute filament.

Together the MD and CD protuberances 22, 38 extend continuously across the fabric in the MD and CD direction, respectively, to form a continuous pattern. The MD and CD protuberances 22, 38 further define a plurality of valleys 24 there between, such as valley 24*a*, which is bound by a pair of spaced apart MD protuberances 22*a*, 22*b* and a pair of spaced apart CD protuberances 38*a*, 38*b*. The discrete valley 24*a* has a rectilinear shape and may be relatively deep.

Test Method

Valley Depth, Valley Width and Wall Angle

The valley depth and angle, as well as other fabric properties, are measured using a non-contact profilometer as described herein. To prevent any debris from affecting the measurements, all images are subjected to thresholding to remove the top and bottom 0.5 mm of the scan. To fill any holes resulting from the thresholding step and provide a continuous surface on which to perform measurements, non-measured points are filled. The image is also flattened by applying a rightness filter.

Profilometry scans of the fabric contacting surface of a sample were created using an FRT MicroSpy® Profile profilometer (FRT of America, LLC, San Jose, CA) and then analyzing the image using Nanovea® Ultra software version 7.4 (Nanovea Inc., Irvine, CA). Samples were cut into squares measuring 145×145 mm. The samples were then secured to the x-y stage of the profilometer using an aluminum plate having a machined center hole measuring 2×2 inches, with the fabric contacting surface of the sample facing upwards, being sure that the samples were laid flat on the stage and not distorted within the profilometer field of view.

Once the sample was secured to the stage the profilometer was used to generate a three-dimensional height map of the sample surface. A 1602×1602 array of height values were obtained with a 30 pin spacing resulting in a 48 mm MD×48 mm CD field of view having a vertical resolution 100 nm and a lateral resolution 6 um. The resulting height map was exported to .sdf (surface data file) format.

Individual sample .sdf files were analyzed using Nanovea® Ultra version 7.4 by performing the following functions:

(1) Using the "Thresholding" function of the Nanovea® Ultra software the raw image (also referred to as the field) is subjected to thresholding by setting the material ratio values at 0.5 to 99.5 percent such that thresholding truncates the measured heights to between the 0.5 percentile height and the 99.5 percentile height; and (2) Using the "Fill In Non-Measured Points" function of the Nanovea® Ultra software the non-measured points are filled by a smooth shape calculated from neighboring points.

(3) Using "Filtering>Wavyness+Roughness" function of the Nanovea® Ultra software the field is spatially low pass filtered (waviness) by applying a Robust Gaussian Filter with a cutoff wavelength of 0.095 mm and selecting "manage end effects";

(4) Using the "Filtering−Wavyness+Roughness" function of the Nanovea® Ultra software the field is spatially high pass filtered (roughness) using a Robust Gaussian Filter with a cutoff wavelength of 0.5 mm and selecting "manage end effects";

(6) Using the "Abbott-Firestone Curve" study function of the Nanovea® Ultra software an Abbott-Firestone Curve is generated from which "interactive mode" is selected and a histogram of the measured heights is generated, from the histogram an S90 value (95 percentile height (C2) minus the 5 percentile height (C1), expressed in units of mm) is calculated.

The foregoing yields three values indicative of the fabric topography valley depth, valley width and wall angle. Valley width is the Psm value having units of millimeters (mm). Valley depth is the difference between C2 and C1 values, also referred to as S90, having units of millimeters (mm). Valley angle is the Pdq value having units of degrees)(°. Generally wall angle and valley width are measured along a line drawn normal to the machine direction axis of the fabric, where the line intersects at least two adjacent MD oriented protuberances.

Element Angle

Before measuring element angle, care must be taken to ensure that fabric is properly oriented before the surface map obtained by the FRT MicroSpy profilometer, as described above. To ensure that the warp filaments are aligned with the MD axis of the fabric and the shute filaments aligned with the CD axis, a shute filament from the bottom of the fabric can be pulled by hand completely across the CD of the fabric to create a single shute filament aligned with the fabric CD axis. The single shute filament may then used as a guide to align the fabric on the profilometer stage and a profilometer scan of the fabric may be obtained as described above.

Once a scan of the fabric is completed and the .sdf is analyzed as described above, the element angle is determined using the "texture direction" function under the "Studies" tab of the Nanovea® Ultra software. Once the "texture direction" is selected, the angle of the three most elevated features on the fabric surface will be reported. To calculate the element angle, the value for the protuberance of interest is selected and subtracted from 90 degrees. The resulting value is the element angle, having units of degrees.

Embodiments

In a fist embodiment the present invention provides a machine direction axis and a cross-machine direction axis, the fabric comprising: a plurality of machine direction (MD) oriented warp filaments and a plurality of cross-machine direction (CD) oriented shute filaments, the shute filaments being interwoven with warp filaments to provide a machine contacting fabric side and opposed web contacting fabric side, the web contacting fabric side having first and second twill woven MD oriented protuberances and first and second twill woven CD oriented protuberances, wherein the CD oriented protuberances intersect the MD oriented protuberances and together bound discrete valleys.

In a second embodiment the present invention provides the woven papermaking fabric of the first embodiment wherein the first and second twill woven MD oriented protuberances and the first and second twill woven CD oriented protuberances are continuous.

In a third embodiment the present invention provides the woven papermaking fabric of the first or second embodiment wherein the first and second twill woven MD oriented protuberances have an element angle from 5.0 to 10.0 degrees.

In a fourth embodiment the present invention provides the woven papermaking fabric of the first through third embodiments wherein the first and second twill woven CD oriented protuberances have an element angle from 65 to 75 degrees.

In a fifth embodiment the present invention provides the woven papermaking fabric of the first through fourth embodiments wherein the discrete valleys have a wall angle greater than about 22 degrees.

In a sixth embodiment the present invention provides the woven papermaking fabric of the first through fifth embodiments wherein the discrete valleys have a depth from about 0.30 to about 1.00 mm.

In a seventh embodiment the present invention provides the woven papermaking fabric substantially of any one of the first through sixth embodiments wherein the discrete valleys have a rectilinear shape.

In an eighth embodiment the present invention provides the woven papermaking fabric substantially of any one of the first though seventh embodiments wherein the first and second twill woven MD oriented protuberances comprise from 2 to 6 warp filaments and the first and second twill woven CD oriented protuberances comprise from 2 to 6 shute filaments.

In a ninth embodiment the present invention provides the woven papermaking fabric of any one of the first through eighth embodiments wherein the first and second MD oriented protuberances comprise from 2 to 6 directly adjacent warp filaments and each of the warp filaments has a float length from 4 to 40.

In a tenth embodiment the present invention provides the woven papermaking fabric of any one of the first through ninth embodiments wherein the first and second twill woven MD oriented protuberances have an upper surface lying in a first fabric surface plane and the first and second twill woven CD oriented protuberances have an upper surface lying in a second fabric surface plane and the discrete valleys have a valley bottom lying in a valley bottom surface plane.

In an eleventh embodiment the present invention provides the woven papermaking fabric of the tenth embodiment wherein the first fabric surface plane lies above the second fabric surface plane and the valley bottom surface plane.

In a twelfth embodiment the present invention provides the woven papermaking fabric of the tenth embodiment wherein the first fabric surface plane lies below the second fabric surface plane and above the valley bottom surface plane.

In a thirteenth embodiment the present invention provides the woven papermaking fabric of the tenth embodiment wherein the first fabric and second fabric surface planes are substantially coplanar and both the first fabric and second fabric surface planes lie above the valley bottom surface plane.

What is claimed is:

1. A woven papermaking fabric having a machine direction axis and a cross-machine direction axis, the fabric comprising: a plurality of machine direction (MD) oriented warp filaments and a plurality of cross-machine direction (CD) oriented shute filaments, the shute filaments being interwoven with warp filaments to provide a machine contacting fabric side and opposed web contacting fabric side, the web contacting fabric side having first and second twill woven MD oriented protuberances and first and second twill woven CD oriented protuberances, wherein the CD oriented protuberances intersect the MD oriented protuberances and together bound discrete valleys having a depth of 0.5 mm or greater.

2. The woven papermaking fabric of claim 1 wherein the first and second twill woven MD oriented protuberances and the first and second twill woven CD oriented protuberance are continuous.

3. The woven papermaking fabric of claim 1 wherein the first and second twill woven MD oriented protuberances have an element angle from 5.0 to 10.0 degrees.

4. The woven papermaking fabric of claim 1 wherein the first and second twill woven CD oriented protuberances have an element angle from 65 to 75 degrees.

5. The woven papermaking fabric of claim 1 wherein the discrete valleys have a wall angle greater than about 22 degrees.

6. The woven papermaking fabric of claim 1 wherein the discrete valleys have a rectilinear shape.

7. The woven papermaking fabric of claim 1 wherein the first and second twill woven MD oriented protuberances comprises from 2 to 6 warp filaments and the first and second twill woven CD oriented protuberances comprises from 2 to 6 shute filaments.

8. The woven papermaking fabric of claim 1 wherein the first and second twill woven MD oriented protuberances have substantially similar height, width and length.

9. A papermaking fabric woven from a plurality of interwoven shute and warp filaments and having a machine contacting surface and an opposite web contacting surface, the web contacting surface comprising a plurality of MD oriented protuberances woven in a twill pattern from two or more directly adjacent warp filaments, wherein each warp filament has a float length from 4 to 50 and the two or more directly adjacent warp filaments have a paired portion having a float length from 2 to 8 and a plurality of CD oriented protuberances woven in a twill pattern from two or more directly adjacent shute filaments, wherein each shute filament has a float length from 4 to 50 and the two or more directly adjacent shute filaments have a paired portion having a float length from 2 to 8 wherein the plurality of MD oriented protuberances are intersected by the plurality of CD oriented protuberances and define a plurality of discrete valleys having a depth of 0.5 mm or greater there between.

10. The woven papermaking fabric of claim 9 wherein the first and second twill woven MD oriented protuberances and the first and second twill woven CD oriented protuberance are continuous.

11. The woven papermaking fabric of claim 9 wherein the first and second twill woven MD oriented protuberances have an element angle from 5.0 to 10.0 degrees.

12. The woven papermaking fabric of claim 9 wherein the first and second twill woven CD oriented protuberances have an element angle from 65 to 75 degrees.

13. The woven papermaking fabric of claim 8 wherein the first and second twill woven MD oriented protuberances have a wall angle greater than about 22 degrees.

14. The woven papermaking fabric of claim 9 wherein the discrete valleys have a rectilinear shape.

15. A woven papermaking fabric comprising:

a. a pair of spaced apart machine direction (MD) oriented protuberances formed from two or more woven warp filaments and having a non-zero element angle and an upper surface lying in a first fabric surface plane;

b. a pair of spaced apart cross-machine direction (CD) oriented protuberances formed from two or more woven shute filaments having a non-zero element angle and an upper surface lying in a second fabric surface plane;

wherein the pair of MD oriented protuberances and the pair of CD oriented protuberances intersect one another and bound a discrete valley having an upper surface lying a valley bottom plane and wherein the valley bottom plane is below the first and second fabric surface planes and the discrete valleys have a depth of 0.5 mm or greater.

16. The woven papermaking fabric of claim 15 wherein no shute filaments forming the CD oriented protuberances are woven above the warp filaments forming the MD oriented protuberances.

17. The woven papermaking fabric of claim 15 wherein the first and second MD oriented protuberances are discrete.

18. The woven papermaking fabric of claim 15 wherein the first and second MD oriented protuberances are continuous.

19. The woven papermaking fabric of claim 15 wherein the first and second MD oriented protuberances have an element angle from 0.5 to 10.0 degrees.

20. The woven papermaking fabric of claim 15 wherein the valleys are from two to ten warps wide.

21. The woven papermaking fabric of claim 15 wherein the first and second MD oriented protuberances have a width from about 1.5 to about 3.5 mm.

22. The woven papermaking fabric of claim 15 wherein the first and second protuberance are parallel to one another and spaced apart from about 1.5 to about 3.0 mm.

23. The woven papermaking fabric of claim 15 wherein the MD oriented protuberances comprise from 2 to 6 warp filaments.

24. The woven papermaking fabric of claim 15 wherein the first and second surface planes are substantially co-planar.

25. The woven papermaking fabric of claim 15 wherein the first surface plane is above the second surface plane.

26. The woven papermaking fabric of claim 15 wherein the first surface plane is below the second surface plane.

* * * * *